US006377764B1

(12) United States Patent
Morris-jones

(10) Patent No.: US 6,377,764 B1
(45) Date of Patent: Apr. 23, 2002

(54) METHOD AND APPARATUS FOR COMMUNICATION, WITHOUT A SOLID MEDIUM, AMONG CONTROL BOARDS IN A PRINTING APPARATUS

(75) Inventor: Stephen Morris-jones, Welwyn (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/603,860

(22) Filed: Jun. 26, 2000

(51) Int. Cl.[7] ..... G03G 15/00
(52) U.S. Cl. ..... 399/75
(58) Field of Search ..... 399/75, 1, 11, 399/13, 81, 364, 407

(56) References Cited

U.S. PATENT DOCUMENTS

| | | | | |
|---|---|---|---|---|
| 4,873,431 A | * | 10/1989 | Ito | 399/11 X |
| 5,049,898 A | | 9/1991 | Arthur et al. | 346/1.1 |
| 5,525,031 A | | 6/1996 | Fox | 414/789 |
| 5,537,920 A | | 7/1996 | Hasegawa et al. | 101/116 |
| 5,567,063 A | | 10/1996 | Chiu | 400/174 |
| 5,642,205 A | * | 6/1997 | Kassmann | 399/364 X |
| 5,978,621 A | * | 11/1999 | Glemser et al. | 399/407 X |
| 6,058,276 A | * | 5/2000 | Leveto | 399/81 |
| 6,067,425 A | * | 5/2000 | Takarabe et al. | 399/1 |
| 6,177,739 B1 | * | 1/2001 | Matsudaira et al. | 399/81 X |
| 6,181,885 B1 | * | 1/2001 | Best et al. | 399/13 X |

FOREIGN PATENT DOCUMENTS

JP 58-62661 * 4/1983

* cited by examiner

*Primary Examiner*—Fred L Braun
(74) *Attorney, Agent, or Firm*—R. Hutter

(57) ABSTRACT

In a digital printing apparatus, various modules each perform a specific function, such as paper feeding, marking sheets, interpreting image data from high-level formats, and performing finishing operations. One or more of these modules includes a board therein, which is able to communicate with another board within the apparatus by infrared or other wireless communication. Such wireless communication obviates the need for large and expensive wire harnesses. There may further be provided barrier structures within the apparatus to prevent crosstalk among various wireless-capable boards. The interaction of the modules facilitates a method of outputting prints.

17 Claims, 2 Drawing Sheets

METHOD AND APPARATUS FOR COMMUNICATION, WITHOUT A SOLID MEDIUM, AMONG CONTROL BOARDS IN A PRINTING APPARATUS

FIELD OF THE INVENTION

The present invention relates to communication among control modules in a printing apparatus, such as a xerographic or ink-jet printer or copier.

BACKGROUND OF THE INVENTION

Digital printing apparatus, such as xerographic copiers or "laser printers," or inkjet printers, are well known. Particularly in the high-speed range of the market, such printers are complicated electromechanical devices. Many such devices can be designed in modular fashion, with a customer buying or leasing only those portions of the apparatus that are desired. For example, a basic printer which simply outputs prints can be provided with a finisher module, which can staple sets of prints. The printer can be provided with a feeder module having extra paper trays for supplying paper of various sizes and types. The printer can further be associated with an input scanner, for obtaining digital data from hard copy originals, thus causing the printer to be able to operate as a copier. Even within the single "box" of a digital printer, there may be numerous hardware boards, each board having a distinct function within the printer, such as data management, image processing, and xerographic control.

In order to design a robust system of office equipment including printers and scanners, complicated connections must be made among the various boards within a printer, and also among the control systems of ancillary devices, such as finishers, paper supply feeders, and scanners, which may be associated with one or more printers. As is well known in the art, typical means of communication of complicated signal sets includes wire harnesses or flexible connectors. In the basic assembly of office equipment, design and management of these harnesses or connectors is a labor intensive process, and the presence of large harnesses may present reliability problems over the life of the equipment. When printers are combined with ancillary equipment to form larger systems, establishment of communication among the various modules similarly becomes a labor-intensive, reliability-sensitive process.

The present invention is directed to the novel use of wireless connections among individual boards and other modules in office equipment.

DESCRIPTION OF THE PRIOR ART

In the prior art, it is known to use infrared signals, using well known protocols, to convey image data from a general purpose computer to a printer. Examples of this principle are shown in U.S. Pat. Nos. 5,543,897; 5,510,876; 5,774,759; and 6,026,258. In each of these cases, however, the original image data which originates in a particular computer in is ultimately in a page description language (PDL) format, meaning that the image data is in the same format used for any standard communication between a computer and printer. The present invention, in contrast, relates to transfer of image and control data among individual modules, which together operate as a single digital printing apparatus.

SUMMARY OF THE INVENTION

According to one aspect of the present invention, there is provided a printing apparatus for outputting prints based on digital image data, comprising a main control board and an image processing board, for processing digital image data from an image data source, and outputting processed digital image data which is substantially directly operative of printing hardware. A print engine includes printing hardware for placing marks on a print sheet based on the processed digital image data, and a print engine board for accepting digital image data and operating the hardware. Means are provided for facilitating wireless data transfer between at least two of the main control board, image processing board, and print engine board.

According to another aspect of the present invention, there is provided a printing apparatus for placing images on sheets, comprising a main portion, including a first board, and an ancillary module including an ancillary board. The ancillary module is at least one of a paper supply module including a supply control board and a finisher module including a finisher supply board. Means are provided for wireless data transfer between the first board and the ancillary board to facilitate placing an image on a sheet.

According to another aspect of the present invention, there is provided an ancillary module for use with a printing apparatus, the ancillary module being at least one of a paper supply module including a supply control board and a finisher module including a finisher supply board, comprising means for accepting wireless data transfer from a first board associated with a printing apparatus.

According to another aspect of the present invention, there is provided a method of outputting prints based on digital image data, comprising the step of transferring, in a wireless manner, processed digital image data which is substantially directly operative of printing hardware from a first board to a print engine control board.

DETAILED DESCRIPTION OF THE INVENTION

Figure 1:
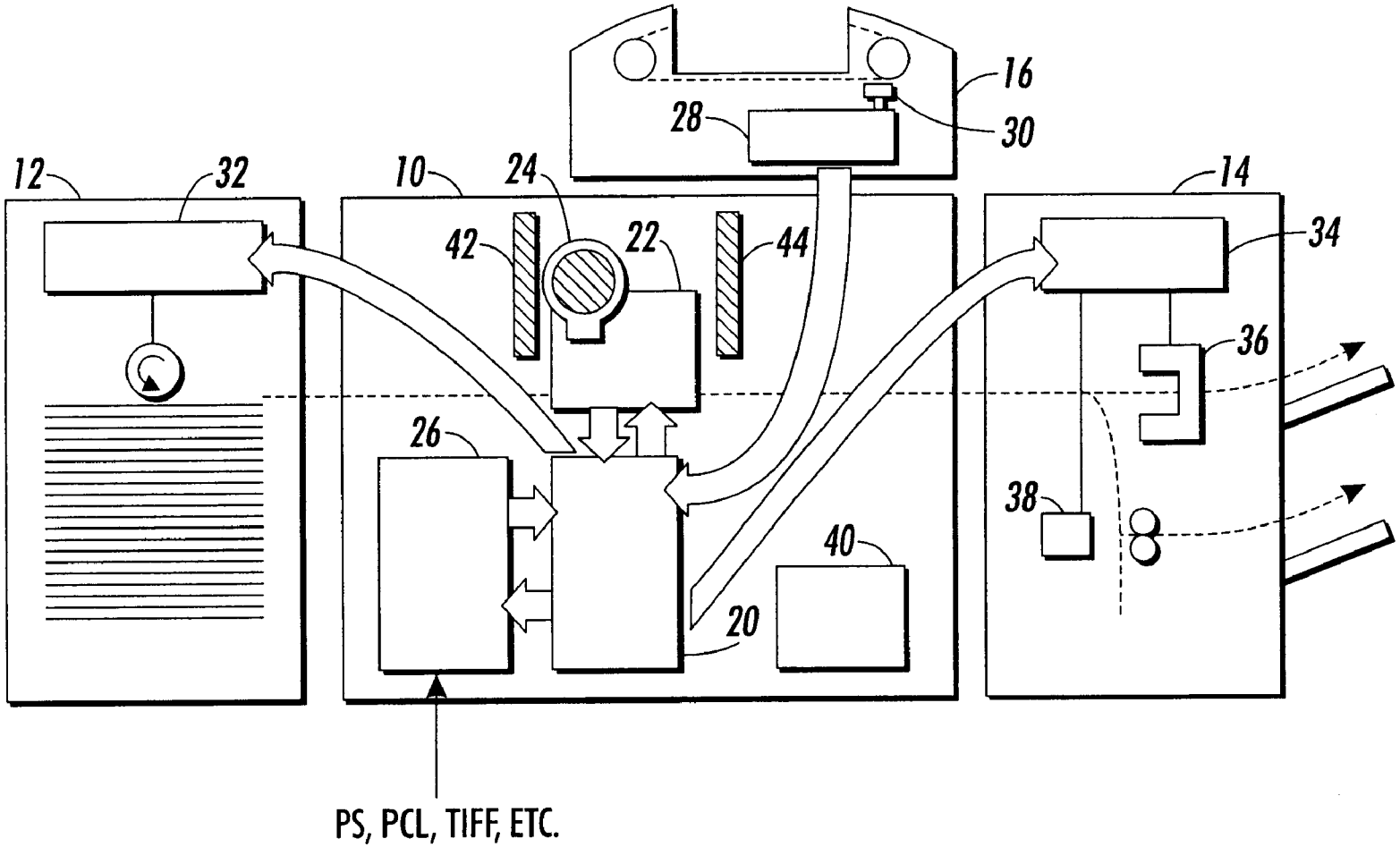
FIG. 1 is a simplified elevational view showing the essential elements of a digital printing apparatus, in this case a digital copier and printer, incorporating the present invention.

FIG. 1 is an elevational view of a digital printing apparatus, specifically a digital copier and printer, incorporating the present invention. In general, the present invention is directed toward operation with office equipment which, at one stage or another, places marks in response to digital data originating from a computer or other image data source, such as an input scanner. The present invention is particularly useful for realization of large, modular based, copying and printing systems, where there may exist, in addition to the essential printing hardware, any number of selectable paper supply modules, finishers, etc.

In the following description and claims, certain terms will be defined as follows. A module is an entity which performs some physical function, such as putting marks on a sheet, feeding a sheet, scanning a sheet, or stapling a sheet. A board is set of hardware and software which controls a module. Typically, a board is simply a circuit board, such as including a microprocessor or other chips, along with software which operates on the board; however, according to the present definition, a board may physically include multiple boards, or be formed in only a portion of a larger circuit board. As used herein, the word data shall generally apply to any type of data, particularly control data and image data. Control data is data which is either directly operative of hardware, or which results from an event experienced by hardware; for example, a pulse which causes a motor to draw a sheet from a stack is control data, as well as a signal which results when and a sensor detects a paper jam. In contrast, image data is data at which is symbolic of an image which is either recorded or which can be printed. As used herein, processed image data shall be defined as image data in a form which is substantially directly operative of a marking device, such as an ink jet printhead or a laser used in an electrophotographic apparatus. This processed image data is ultimately in a binary form which controls, for instance, whether a laser or a particular ink-jet ejector is actuated at a particular time; however, such processed image data can, according to the definition herein, be in a compressed form, such as by run-length encoding. In contrast, image data which is not processed as that term is here defined is in the form of a page description language (PCL, Adobe PostScript® ASCII etc.) or other highly structured format such as TIFF or a facsimile format.

Turning to FIG. 1, a digital printing apparatus having a main body generally indicated as 10 may further have associated therewith various substitutable ancillary modules, such as a separate paper supply module 12 or a finisher module 14, as well as a separable input scanner 16. In a typical arrangement of office equipment, the main body 10 includes the print engine, which is the set of software and hardware which places marks on sheets to result in prints.

Exercising general control over an entire system is preferably a main control board 20. Foremost among auxiliary modules controlled by main control board 20 is the print engine 22, which may be of any basic type known in the art, such as a xerographic "laser printer" apparatus, an ink jet device, or some equivalent. The important attribute of print engine 22 is that it places marks on sheets passing therethrough in accordance with processed digital image data, as defined above. Print engine 22 may further have associated therewith specialized paper feeding apparatus (not shown), such as a duplexing device, paper jam detectors, as well as provision for accepting paper feed signals, etc. Print engine 22 includes therein a print engine control board which converts control data and image data to operate the hardware therein (the print engine control board is not discretely shown in the Figure, as it is typical that such a board is integral to any design of a print engine that accepts digital data). Print engine 22 may also have associated therewith a removable marking material supply, such as shown as 24, which may be in the form of a supply of toner or liquid ink of various colors. The print engine control board may have means for determining, either by direct measurement or inferred by a cumulative use, the amount of marking material associated with supply 24 at any given time. Indeed, the marking material supply 24 may itself have associated therewith a board which can interacte with other boards within the apparatus.

One source of image data to be supplied to print engine 22 under the control of main control board 20 is what is here called an image processing board 26. Specifically, image processing board 26 may include one or more decomposers, or interpreters, meaning software which converts image data it receives into a form immediately usable by print engine 22; that is, the image processing board 26 receives digital image data and outputs processed digital image data. Typical examples of digital image data to be received by image processing board 26 include data in known page description languages, as well as other highly structured formats such as TIFF or facsimile formats. Depending on the particular design of the equipment, processed image data output from image processing board 26 may be transferred directly to the board within print engine 22, or be routed through main control board 20.

Another possible source of image data for outputting by print engine 22 is original hard copy images. Such hard copy images can be fed through a scanner 16, of a general design which is known in the art. For purposes of describing the present invention, the scanner 16 may include a scanner control board indicated as 28. Depending on the specific design of the apparatus, scanner control board 28 may include provisions for controlling the various motors for feeding the original sheets in series, and/or processing original data recorded by a photosensor such as indicated as 30. Original image data collected by input scanner control board 28 is eventually directed to main control board 20 for placing in a form which is acceptable to print engine 22, such as to create digital copies of the original images from scanner 16.

Blank sheets on which images are to be printed by the print engine 22 can be stacked in one or more paper supply modules such as 12, which will feed individual sheets to the print engine 22 when instructed to do so by main control board 20. In a highly modular design of office equipment, a paper supply module 12 may include therein a supply module board 32, which is designed to be a operated by the main control board 20 when a particular module 12 is installed relative to the main portion: indeed, in a high-speed system, it is typical to have numerous supply modules 12 be selectably available as different types of input sheets, of different sizes, weights, or colors. Alternately, such control data for drawing and feeding sheets may come from the print engine control board within print engine 22.

After sheets are printed with images by print engine 22, the print sheets are then directed to one or more finisher modules such as 14. Each finisher module 14 may have included therein a finisher control board such as 34, which in turn directly controls finisher hardware for performing finisher operations on sheets received in the module 14. Typical among these types of finisher hardware are a stapler 36 or a folding device 38. Another popular option for advanced finishing equipment is to provide multiple output trays or mailboxes (not shown), to which different sets of sheets are directed depending on the identity of the person ordering the print job. Signals to cause various parts of a finisher module 14 to perform various functions may originate within main control board 20 or from the print engine control board within print engine 22, and are sent to finsher control board 34.

With specific reference to the present invention, the various boards associated with the apparatus is shown in the Figure can variously be caused to interact with other boards by wireless data transfer, specifically by infrared communication. Various protocols for transferring data of any kind through infrared means are well known. The novelty of the present invention is that such infrared or other wireless communication takes place not merely from a host computer transferring image data in a highly structured format to a printing apparatus in general, but among the various specific modules within a digital printing apparatus. In the specific illustrated embodiment, the various possible paths of wireless data transfer are shown by heavy arrows among the illustrated modules; although certain key paths are illustrated, the present invention need not be limited to those shown in the Figure.

The most important areas of data transfer, particularly for non-processed and processed digital image data transfer, exist between main control board 20 and print engine 22, as well as between main control board 20 and image processing board 26. In either case, the data which is transferred between various pairs of modules may comprise either or both control data, such as relating to paper feeding and paper jams, and image data, particularly processed image data which can be directed to the control board within print engine 22.

Further according to possible embodiments of the present invention, there may further be wireless data transfer between the main control board 20 or other boards within the apparatus and control boards associated with the supply module 12 or the finisher module 14, that is the supply control board 32 or finisher control module 34, or multiple instances of either such boards. Operation of, for example, the control board 32 associated with one supply module 12 may be as follows. When, in the course of operating the printing apparatus to output prints, it is necessary for a blank sheet to be drawn from a feeder module 12 through print engine 22, a signal is sent by wireless means from either main control board 20 or print engine 22 itself to the feeder control board 32. If there exist multiple supply modules 12 each with its own control board 32, the signal can be directed, through means associated with the standard protocols, to be responded to only by the board 32 associated with the stack of input sheets desired to be drawn from. Similarly, with finisher module 34, at a particular time following the printing of a sheet by print engine 22, or more specifically, a particular sheet in a set, the main control board 20 can send a signal by wireless means to control board 34 in finisher module 14, for example, to command the stapler 36 to staple a set of accumulated sheets. In the claims herein, a supply module such as 12 and a finisher module such as 14 (or any other kind of module) are referred to generically as an ancillary module, having an ancillary board.

A particular advantage of using wireless communication among modules associated with paper supply and finishing is that advanced systems with numerous selectable supply and finisher modules can be readily assembled simply by placing the desired modules along the paper path of the apparatus as a whole; because of the wireless communication between main control board 20 and the boards such as 32 and 34 in the supply and finisher modules, no complicated hardware connection must be made by a casual user setting up the printing apparatus. In the case of the wireless connection between the print engine control board and a board such as main control board 20 or image processing board 26, even though the Figure shows these two boards inside the same main body 10, it is conceivable that the print engine board could be disposed in a module separate from modules containing boards sending processed image data thereto: for instance, a module containing a print engine with associated control board could be simply placed in a room with one or more modules which, at various times, send processed image data thereto.

If it is desired to use a digital printing apparatus as a digital copier, such as for copying original hard copy images, a scanner 16 can be placed in the vicinity of the main body 10 of the digital printing apparatus, having main control board 20 therein. In such a case, the wireless data transfer from scanner control board 28 to main control board 20 may include both image data and control data. Depending on a particular design of a system, the image data may directed from scanner control board 28 to main control board 20 or perhaps directly to the print engine control board in print engine 22.

According to a preferred embodiment of the present invention, all the various boards which emit and/or receive infrared signals in the course of interacting with other boards share a single power supply 40. It may be desirable to extend the power supply lines (not shown) from the power supply 40 within main body 10 to the various ancillary modules such as 12 and 14; i.e., have a wire-based connection of the power supply even if the data connection among the main portion and ancillary modules is wireless.

In a practical embodiment of the present invention, it may be desirable to configure the various wireless-capable modules in such a way that there is a relatively clear path between and a board acting as an emitter of infrared signals and a board intended to receive infrared signals. Many commercial types of infrared emitters are reasonably directional, and therefore the infrared transmitter can be aimed toward an area where a receiver module is likely to be disposed. Alternately, or to improve performance, barriers, such as shown for example as 42 or 44 in the Figure, which are largely infrared impermeable, may be set up in various configurations within the equipment. These barriers may be made of any infrared impermeable material, such as heavy plastic. These barriers will reduce crosstalk among different modules in the apparatus, and can be designed (in terms of material and/or configuration) to restrict travel of the type of energy used for any kind of wireless data transfer, such as microwave or ultrasound.

Although the preferred embodiment of the present invention involves use of known infrared communication hardware and protocols, other types of wireless communication among the various boards may be contemplated. Microwave or ultrasound communication may be practical in certain circumstances. For ancillary modules such as 12 or 14 which must be directly abutted to main portion 10, a simple optical coupling between modules may be practical.

Figure 2:
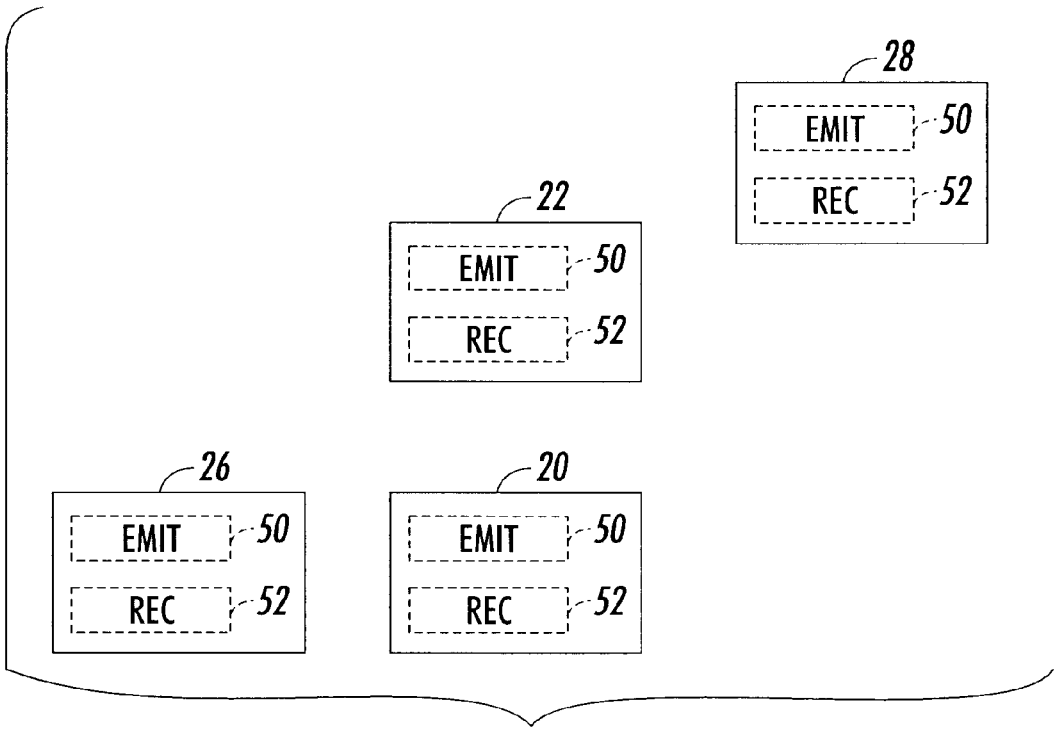
FIG. 2 is a simplified elevational view showing the essential elements of various modules within a digital copier and printer, incorporating the present invention.

FIG. 2 is a simplified elevational view showing the modules 20, 22, 26 and 28, such as described above in the context of a printing or copying apparatus. As can be seen in FIG. 2, each module includes an "emitter" portion 50 and a "receiver" portion 52. The emitter portion functions to transmit data, in a wireless form, to other modules as per the basic functions of a particular module. In turn, the receiver portion 52 of each module includes hardware to receive such wireless data for the purpose of the module. In possible embodiments of the invention, the emitter 50 can transmit data in the form of infrared radiation, RF, microwave, ultrasound, or any other form which does not require a solid medium through which to convey signals.

What is claimed is:

1. A printing apparatus for outputting prints based on digital image data, comprising:

a main control board;

an image processing board, for processing digital image data from an image data source, and outputting processed digital image data which is substantially directly operative of printing hardware;

a print engine, including printing hardware for placing marks on a print sheet based on the processed digital image data, and a print engine board for accepting digital image data and operating the hardware;

means for facilitating data transfer without a solid medium between at least two of the main control board, image processing board, and print engine board.

2. The apparatus of claim 1, wherein the means for facilitating data transfer includes means for emitting infrared radiation.

3. The apparatus of claim 1, wherein the means for facilitating data transfer includes means for emitting microwave radiation.

4. The apparatus of claim 1, wherein the means for facilitating data transfer includes means for emitting ultrasound.

5. The apparatus of claim 1, further comprising a finisher, for handling print sheets output from the print engine, and a finisher board for controlling the finisher; and means for facilitating wireless data transfer without a solid medium between the finisher board and at least one of the main control board and the print engine board.

6. The apparatus of claim 1, further comprising at least one supply module for providing blank sheets to be fed to the print engine, and a supply module board for operating the supply module; and means for facilitating data transfer without a solid medium between the supply module board and at least one of the main control board and the print engine board.

7. The apparatus of claim 1, further comprising an input scanner, for obtaining digital image data from a hard-copy original image, including an input scanner board for controlling the input scanner; and means for facilitating data transfer without a solid medium between the input scanner board and at least one of the main control board and the print engine board.

8. A printing apparatus for outputting prints based on digital image data, comprising:

a main control board;

an image processing board, for processing digital image data from an image data source, and outputting processed digital image data which is substantially directly operative of printing hardware;

a print engine, including printing hardware for placing marks on a print sheet based on the processed digital image data, and a print engine board for accepting digital image data and operating the hardware;

means for facilitating wireless data transfer between at least two of the main control board, image processing board, and print engine board; and a barrier for restricting energy associated with the wireless transfer.

9. An apparatus for processing digital image data, comprising:

a main control board, the main control board being at least indirectly operative of a print engine;

a scanner control board, the scanner control board being operative of a scanner for recording image data from a document;

means for facilitating data transfer without a solid medium between the main control board and the scanner control board.

10. The apparatus of claim 9, wherein the means for facilitating data transfer includes means for emitting infrared radiation.

11. The apparatus of claim 9, wherein the means for facilitating data transfer includes means for emitting microwave radiation.

12. The apparatus of claim 9, wherein the means for facilitating data transfer includes means for emitting ultrasound.

13. The apparatus of claim 9, further comprising a barrier for restricting energy associated with the data transfer.

14. The apparatus of claim 9, further comprising a print engine control board which is directly operative of a print engine, the main control board being operative of the print engine control board.

15. The apparatus of claim 14, further comprising means for data transfer without a solid medium between the main control board and the print engine control board.

16. A method of outputting prints based on digital image data, comprising the step of:

in a wireless manner, transferring processed digital image data which is substantially directly operative of printing hardware from a first board to a print engine control board;

wherein there is provided, proximate to one of the first board and the print engine board, a barrier for restricting energy associated with the transferring step.

17. The method of claim 16, wherein the first board and the print engine control board are disposed within a single main portion of a printing apparatus.

* * * * *